United States Patent [19]

Miner

[11] 4,245,776

[45] Jan. 20, 1981

[54] PASS-THROUGH DRAWER ASSEMBLY

[75] Inventor: John E. Miner, Warren, Mich.

[73] Assignee: Security Corporation of Michigan, Royal Oak, Mich.

[21] Appl. No.: 52,156

[22] Filed: Jun. 26, 1979

[51] Int. Cl.[3] ..... E06B 7/32; E05G 7/00

[52] U.S. Cl. ..... 232/43.3; 232/43.5; 312/286

[58] Field of Search ..... 312/209, 212, 242, 270, 312/286, 236; 109/19; 232/43.1–43.5, 44

[56] References Cited

U.S. PATENT DOCUMENTS

| | | | |
|---|---|---|---|
| 3,059,840 | 10/1962 | Graber et al. | 232/44 |
| 3,390,833 | 7/1968 | Harris | 232/43.3 |
| 4,135,658 | 1/1979 | Hagberg | 232/43.1 |
| 4,149,474 | 4/1979 | Ruane | 232/43.3 |

*Primary Examiner*—Casmir A. Nunberg
*Attorney, Agent, or Firm*—Cullen, Sloman, Cantor, Grauer, Scott & Rutherford

[57] ABSTRACT

A pass-through drawer assembly is disclosed for transferring food and other commodities from an operator inside an enclosed area to a customer on the other side of the enclosure. The drawer assembly includes a drawer frame which is encased in a box-like housing having an opening covered by a hinged door on the operator's side and a pair of exterior hinged doors on the customer's side. A handle device is attached to the drawer frame so that the employee may horizontally extend and retract the drawer frame between the exterior doors to the customer. The drawer frame includes a bottom cam plate which has opposed camming slots, and the exterior doors have cam followers secured thereto that mate within the slots in such a manner that when the drawer frame is extended the exterior doors are progressively opened and when the drawer frame is retracted the doors are closed. The configuration of the camming slots and the position of the cam followers on the doors permit the doors to open less than 90° such that if a vehicle or the like strikes the doors in their open position, the doors and drawer frame automatically close.

10 Claims, 4 Drawing Figures

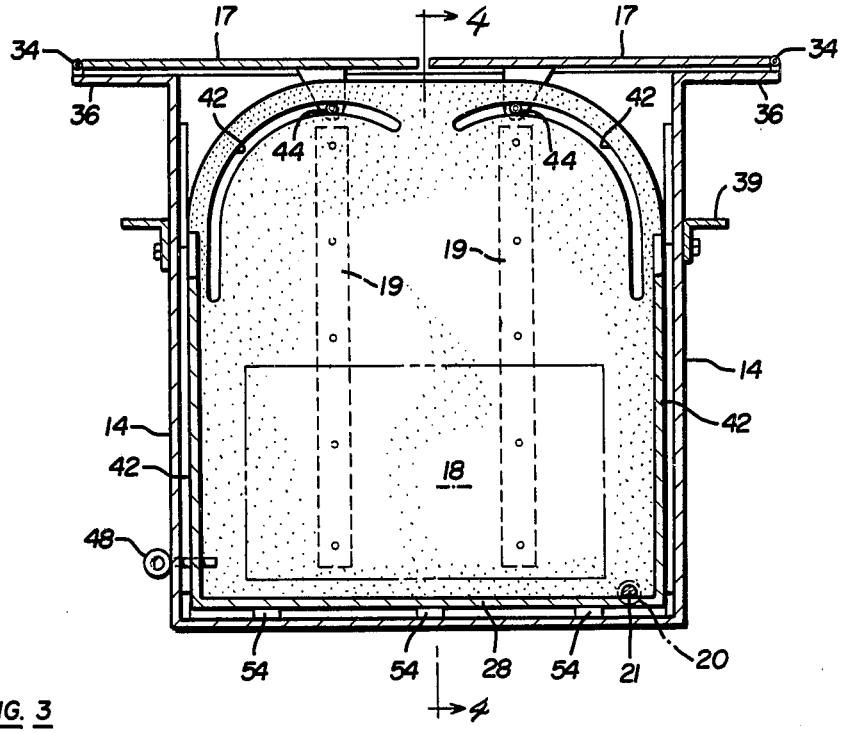
FIG. 3
FIG. 4
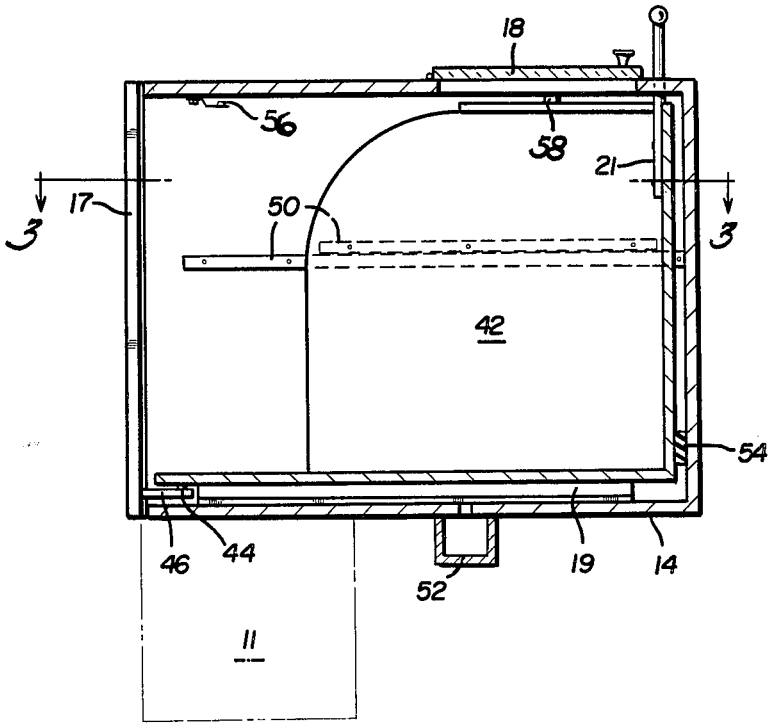

PASS-THROUGH DRAWER ASSEMBLY

BACKGROUND OF THE INVENTION

The present invention relates to drive-up or walk-up window constructions and more particularly to an improved pass-through drawer assembly mounted in the outer wall of a building or enclosure so that food or other commodities may be transferred from inside the building to a customer standing outside or seated in a vehicle outside the building.

Drive-up or walk-up window constructions have been used in various environments such as for banking, retail sales, etc., wherein it is desired to make direct business transactions between a customer outside an enclosure and a business employee positioned within the enclosure. For these business transactions, the individual inside the enclosure is able to see the customer through a window in the outer wall of the enclosure and to communicate with the customer through a suitable speaking system. Transfers of bank books, food, or retail merchandise are made through a movable deposit unit in the wall near the window.

The deposit unit is typically moved by hand from a closed position where it is only accessible from within the enclosure to an open position where it projects outwardly from the enclosure for access by a customer either standing outside the enclosure or sitting in a vehicle outside the enclosure. The normal drawer unit is horizontally slidable to a projecting open position, and when the unit is left in its open position, a vehicle, for example, can be damaged by or cause damage to the projecting deposit unit. Thus, there has been a need for an improved pass-through drawer assembly which is movable horizontally between closed and open positions but which will be automatically returned from the open to the closed position if it is contacted by a vehicle or otherwise struck.

Certain prior art drawer assemblies have been adapted for automatic operation, but they require complicated mechanisms including limit switches, motors and timers to cause the movement of the drawer assembly from its open to its closed position to prevent an automobile or the like from striking it. These prior art attempts for automatically closing the drawer assembly are not fool-proof, and there has been a need for a pass-through drawer assembly which is simply adapted for automatic closing when struck during its operation.

These and other disadvantages of present pass-through drawer assemblies have resulted in the present drawer assembly for transferring food and other commodities from inside an enclosure to a customer outside the enclosure.

SUMMARY OF THE INVENTION

The pass-through drawer assembly of the present invention is intended to be mounted in the outer wall of an enclosure having a window such that food or other commodities may be transferred from within the enclosure to a customer on the other side of the enclosure.

The drawer assembly includes a movable drawer frame which is mounted within a stationary housing and which is movable horizontally from a fully retracted position accessible by the operator to an extended position accessible by the customer. The drawer frame is extended between and opens a pair of hinged exterior doors mounted to the outside open end of the stationary housing. As the drawer frame is extended, the exterior hinged doors open thereby permitting the customer access to the contents of the drawer frame, and when the drawer frame is retracted, the exterior doors close to prevent access into the housing except by the operator.

The drawer frame which forms an important part of the present invention includes two upstanding spaced apart side walls, a rear upstanding wall connecting the side walls and a bottom cam plate joining the bottom edges of the side walls and rear wall.

The drawer frame of the present invention is encased in a stationary frame housing which is installed within the outer wall of the enclosure beneath a window. The stationary frame housing is box-like with an open end to which a pair of swinging exterior doors are mounted by hinges. The only access to the drawer assembly from the operator's position within the enclosure is through an opening in the stationary housing which is covered by a hinged clear plastic door through which the operator has access to the confines of the drawer assembly when it is in its retracted position.

The movable drawer frame is preferably mounted for extension and retraction on ball-bearing glide tracks which are attached between the underside of the movable drawer frame and the bottom of the stationary frame housing. The movable drawer frame is extended and retracted by a handle device which is operated by the business employee. The handle shaft passes through and is movable within a slot in the stationary housing. One end of the handle shaft is fixed to the movable drawer and the other end which is outside the stationary housing has a knob for holding by the operator.

The handle device may be mounted to the movable drawer assembly at various locations depending on the type of commodity being transferred in the drawer. The slot in the stationary housing is fitted with a flexible two-piece rubber strip which is separable and collapsable along a line colinear with the longitudinal axis of the slot to permit the operator's handle to move along the slot while sealing the slot except in the area through which the handle shaft is passing.

The drawer frame holds and supports a removable tray which can be readily removed for cleaning of the tray or housing interior. Mounted to the removable tray or elsewhere within the drawer assembly is a container for transmitting money from the customer to the operator. The location of the container is dependent upon the type commodity being transferred by the drawer assembly.

The exterior doors which open when the drawer frame is extended are mounted to the exterior open end of the box-like stationary housing by removable hinges. This permits rapid replacement of the doors if they become damaged. Additionally, weather stripping is fitted around the perimeter of the exterior doors such that when the doors are closed, the loss of heat is minimized. A flexible weather strip is also mounted to one of the doors in a cantilevered fashion along its opening edge such that when the doors are in the fully closed position, the other door presses against the weather strip to form a seal.

An important feature of the present invention is the bottom cam plate of the drawer frame which has curved camming slots machined therein for controlling the opening and closing of the exterior doors. Each exterior door is mechanically joined to a respective camming slot by a roller bearing cam-follower device mounted on an angle bracket secured to the door. As the drawer frame is extended outwardly, the cam followers move within the camming slots such that the exterior doors are progressively opened, and as the drawer is retracted, the cam slots and cam followers progressively close the doors. The exterior corners of the cam plate including the corners of the removable tray which sits thereon are curved to facilitate the opening and closing of the exterior doors.

When the drawer frame is fully extended, the exterior doors are opened less than 90° by the cam plate of the drawer frame. The cam slots, cam followers, and exterior door hinges are so configured that if the doors are struck in their open position, the doors and drawer frame automatically move to a closed position. The less than 90° full open position of the exterior doors also reduces the effect of weather and wind to the interior of the drawer assembly and its contents.

A simple pin type lock assembly is provided for the drawer assembly which includes a pin that enters through an opening in the stationary housing and fits into an aligned opening in one of the drawer frame side walls when the drawer frame is fully closed. The openings for the lock pin may be located at any other position to provide a fully closed and locked position for the drawer frame. Further, when the drawer frame is fully retracted, the cam slots also assist in mechanically retaining the exterior doors in their closed position to reduce possible vandalism or the loss of heat.

Attached to the exterior of the side walls of the drawer frame and interior side walls of the stationary housing are glide rails for centering and supporting the drawer frame in the stationary housing. The glide rails which may be made of Teflon (trademark) slide one on the other to assist in carrying heavy loads placed in the drawer assembly. A heating unit may also be attached to the bottom of the stationary housing, and heated air from the heating unit passed around the drawer frame through an opening in the bottom of the stationary housing to maintain the temperature of commodities such as food placed on the removable tray.

Other advantages and meritorious features of the pass-through drawer assembly of the present invention will be more fully understood from the following description of the preferred embodiment, the appended claims, and the drawings, a brief description of which follows.

BRIEF DESCRIPTION OF DRAWINGS

FIG. 3 is a top plan view of the pass-through drawer assembly with the top of the stationary housing removed and the drawer assembly retracted; and FIG. 4 is a side elevational view of the pass-through drawer assembly with a side wall of the stationary housing removed and the drawer assembly in its retracted position.

DESCRIPTION OF THE PREFERRED EMBODIMENT

The pass-through drawer assembly 10 of the present invention is illustrated in FIGS. 1–4. The drawer assembly is intended to be mounted in the outer wall 11 of an enclosure having a window 12 such that food or other commodities may be transferred from an operator within the enclosure to a customer on the other side of the enclosure.

Figure 1:
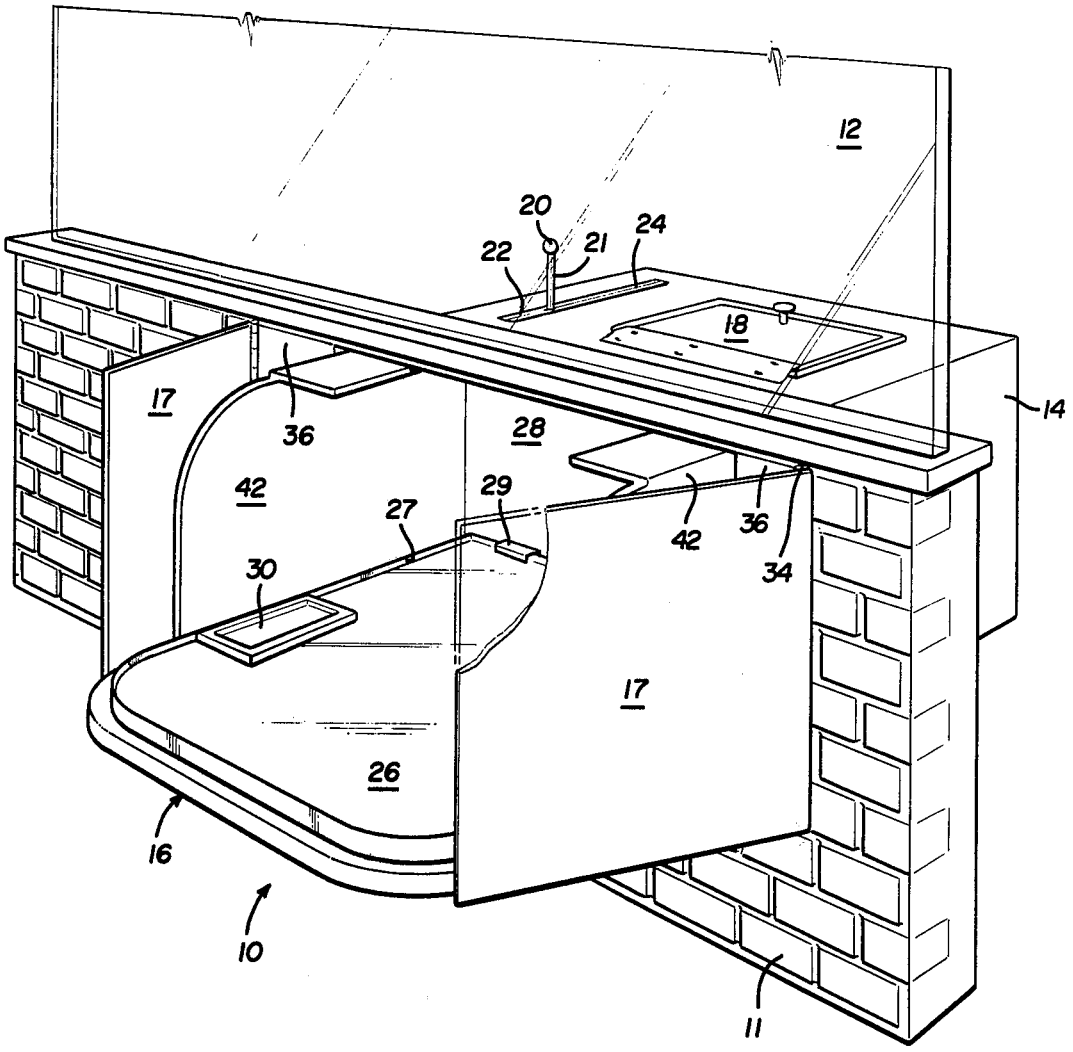
FIG. 1 is a perspective view of the pass-through drawer assembly of the present invention mounted in the outer wall of an enclosure and being in its extended position.
Figure 2:
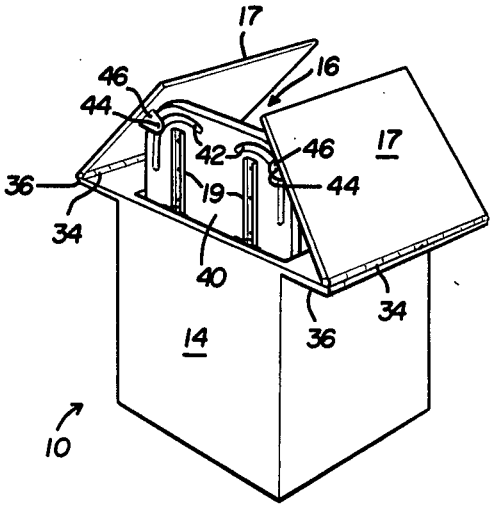
FIG. 2 is a perspective view of the pass-through drawer assembly from its underside illustrating the opening of the exterior doors by the cam plate.

The pass-through drawer assembly 10 includes a stationary box-like frame housing 14 and a horizontally movable drawer frame 16. mounted therein. The drawer frame 16 is horizontally movable from a fully retracted position accessible by the operator as illustrated in FIGS. 3 and 4 to an extended position accessible by the customer as illustrated in FIGS. 1 and 2. Frame 16 is extended between and opens on a pair of hinged exterior doors 17 mounted to the outside open end of the housing 14. As the drawer frame 16 is extended, the exterior doors 17 open thereby permitting the customer access to the contents of the drawer frame, and when the drawer frame is retracted, the exterior doors 17 close to prevent access into the housing 14 except by the operator.

The only access into the drawer assembly from the operator's position within the enclosure is through an opening in the housing 14 which is covered by hinged clear-plastic door 18. The operator passes commodities such as food through door 18 into the drawer assembly and retrieves from the interior the monetary transfers from the customer.

The movable drawer frame 16 is preferably mounted within housing 14 for extension and retraction on ball-bearing glide tracks 19 which are attached between the underside of the movable drawer and the bottom of the stationary frame housing 14. The drawer frame 16 is extended and retracted by a handle device 20 which is operated by the business employee. The handle shaft 21 passes through and is movable in a slot 22 in the stationary housing 14. One end of the shaft 21 is fixed to the movable drawer assembly, and its other end has a knob mounted thereon for holding by the operator.

The handle device may be mounted to the drawer assembly at various locations depending on the commodity being transferred by the drawer. The slot 22 in the stationary housing is fitted with a flexible two-piece rubber strip 24 which is separable and collapsable along a line colinear with the longitudinal axis of the slot 22 to permit the operator's handle to move along the slot and simultaneously seal the slot except in the area through which the handle shaft is passing.

The drawer frame 16 holds and supports a removable tray 26 which can be readily removed for cleaning of the tray and housing interior. An upstanding lip 27 integral with the tray 26 is held against the back wall 28 of the drawer assembly by L-shaped bracket 29 which is mounted to the back wall 28. The tray 26 may be conveniently removed by lifting and tilting its forward end to release the lip 27 from holding engagement with bracket 29. Lip 27 also prevents commodities which are placed onto the tray 26 from sliding off the tray. Mounted at various positions on the lip 27 is a removable container 30 which may be used for transmitting money from the customer to the operator. This container may be positioned at any point around the periphery of the tray.

The stationary box-like frame housing 14 has exterior doors 17 hinged thereto at its open end which open outwardly when the inner movable drawer frame 16 is extended by the operator. The exterior doors 17 are mounted to the stationary housing by removable hinges 34 attached to the outer ends of the out-turned flange portions 36 of housing 14. The removable hinges 34 permit rapid replacement of doors 32 if they should become damaged.

Weather strips are fitted around the perimeter of the exterior doors such that when the doors are closed, the loss of heat is minimized. A rubber weather and bumper strip 38 is secured in a cantilevered fashion along the opening edge of one of the exterior doors 17 such that when the doors are in a fully closed position, the other door will press against weather strip 38 and form a seal.

L-shaped mounting flanges 39 are attached to each side of the housing 14, and they form the means by which the housing and drawer frame are anchored in outer wall 11 of the enclosure. The out-turned flanges 36 of housing 14 and the mounting flanges 39 clasp against the opposed sides of wall 11 to secure the drawer assembly 10 in the opening cut in wall 11 for the mounting of assembly 10.

An important feature of the present invention resides in the movable drawer frame 16 which includes a bottom cam plate 40 spaced from and parallel to the removable tray 26. The cam plate 40 joins with the upstanding side walls 42 and back wall 28 to form the drawer frame 16. Curved camming slots 42 are machined within the cam plate 40 to control the opening and closing of the exterior doors 17. Each exterior door 17 is mechanically joined to a respective camming slot 42 by a roller bearing cam-follower 44 mounted on an angle bracket 46 secured to each door. As the drawer assembly 16 is extended outwardly, the cam followers move within the camming slots 42 such that the exterior doors 17 are progressively opened, and as the drawer assembly 16 is retracted, the cam followers 44 move within cam slots 42 to progressively close the doors. The exterior corners of the cam plate 40 and corners of tray 26 which sits thereon are curved to facilitate the opening and closing of the exterior doors.

When the drawer frame 16 is fully extended as illustrated in FIGS. 1 and 2, the exterior doors 17 are moved less than 90° open by the cam plate 40 of the drawer frame. The cam slots 42, cam followers 44 and exterior door hinges 34 are so configured that if a vehicle or the like strikes the doors in their open position, the doors and drawer frame move to a closed position automatically. The less than 90° full open position of the exterior doors also reduces the effect of weather and wind on the interior of the drawer frame and its contents.

A simple pin type lock assembly is provided for the drawer assembly which includes a pin 48 that extends through an opening in one of the side walls of the stationary housing 14 and enters an aligned opening in one of the drawer frame side walls 42 when the assembly is fully retracted. The openings for the lock pin 48 may be located at any position to provide a fully closed and locked condition for the drawer frame. Additionally, when the drawer frame is fully retracted, the cam slots 42 mechanically assist in retaining the exterior doors 17 in the closed position to reduce vandalism and loss of heat.

Attached to the exterior side walls 42 of the drawer frame and interior side walls of the stationary housing 14 are glide rails 50 for centering and supporting the drawer frame in the stationary housing 14. The glide rails 50 slide one on the other to assist the drawer frame in carrying heavier loads. They may be fabricated of any suitable material including Teflon.

A heating unit 52 is attached to the bottom of the stationary housing 14, and heated air is blown through an opening in the bottom of the stationary housing to heat the contents of the drawer frame to maintain its temperature.

Rubber stops 54 are mounted to the interior rear wall of housing 14 which cushion the drawer frame 16 when it is retracted. An angle bracket 56 is mounted to the interior top wall of housing 14 which is engaged by rubber stops 58 secured to the exterior of the top of drawer frame side walls 42 (FIG. 4) to prevent the drawer frame from being extended beyond its normal outward limit if the cam followers 44 should become broken or disengaged from cam slots 42.

It will be apparent to those skilled in the art that the foregoing disclosure is exemplary in nature rather than limiting, the invention being limited only by the appended claims.

I claim:

1. A pass-through drawer assembly for transferring food and other commodities from an operator inside an enclosure to a customer outside the enclosure, said drawer assembly comprising:

(a) a stationary box-like frame housing having an open end, exterior doors being pivotally connected to mounting portions on the open end of said stationary housing;

(b) a drawer frame mounted within said stationary frame housing on glide means and said drawer frame being movable horizontally from a retracted position inside said stationary housing to an extended position partially outside said housing, said drawer frame having upstanding spaced apart side walls, a rear wall, and a bottom cam plate joining the bottom edges of the side walls and rear wall, said cam plate having a pair of opposed cam slots for controlling the opening and closing of the exterior doors;

(c) cam follower means mounted to each of said exterior doors and movable within a respective cam slot of said drawer frame cam plate;

(d) a handle device for extending and retracting said drawer frame, said handle device secured at one end to said drawer frame and said handle device being movable within a slot in said stationary frame housing, said handle device being used by an operator for extending said drawer frame to open said exterior doors so that the drawer frame passes between said doors to its extended position and for retracting said drawer frame to close said exterior doors and return said drawer frame to its retracted position; and (e) said cam slots being configured to only permit said exterior doors to open less than 90° and said doors and drawer frame automatically moving to a closed position if the doors are struck in their less than 90° open position, said opposed cam slots in said drawer frame cam plate are curved for controlling the opening and closing of said exterior doors, a first portion of one cam slot being generally colinear with a first portion of the other cam slot and said cam slots having second portions that are generally parallel to each other, each said exterior door is mechanically joined to a respective cam slot by a roller bearing cam-follower device mounted on an angle bracket secured to said door, said cam followers moving within said cam slots as said drawer frame is extended outwardly such that the exterior doors are progressively opened, and as said drawer frame is retracted, the cam slots and cam followers progressively closing said exterior doors.

2. The pass-through drawer assembly as defined in claim 1, wherein said stationary housing has an opening covered by a hinged door through which the operator has access to the confines of the drawer assembly when the drawer frame is in its retracted position.

3. The pass-through drawer assembly as defined in claim 2, wherein said slot in said stationary housing is fitted with a flexible two-piece rubber strip which is separable and collapsable along a line colinear with the longitudinal axis of the slot to permit said handle device to move along said slot while sealing the slot except in the area through which the handle device is passing.

4. The pass-through drawer assembly as defined in claim 1, wherein said drawer frame cam plate supports a removable tray which can be readily removed for cleaning of the tray or drawer frame.

5. The pass-through drawer assembly as defined in claim 4, wherein said removable tray includes an upstanding lip which is held against the rear wall of said drawer frame by a bracket mounted to said rear wall, said tray being conveniently removed by lifting and tilting its forward end to release said lip from holding engagement with said bracket.

6. The pass-through drawer assembly as defined in claim 5, wherein a container is mounted on said lip of said removable tray for transmitting money or the like from a customer to the operator.

7. The pass-through drawer assembly as defined in claim 1, wherein a flexible weather strip is mounted to one of said exterior doors in a cantilevered fashion along its opening edge such that when the doors are in their fully closed position, the other door presses against the weather strip to form a seal.

8. The pass-through drawer assembly as defined in claim 1, wherein a pin lock assembly is provided which includes a pin that enters through an opening in said stationary housing and fits into an aligned opening in one of said drawer frame side walls when said drawer frame is fully retracted.

9. The pass-through drawer assembly as defined in claim 1, including glide rails mounted to the exterior side walls of said drawer frame and interior side walls of said stationary housing for centering and supporting said drawer frame in said stationary housing, said glide rails sliding one on the other to assist in carrying heavy loads placed in said drawer frame.

10. The pass-through drawer assembly as defined in claim 1, wherein a heating unit is attached to the bottom of said stationary housing, and heated air blown from said heating unit being passed around said drawer frame through an opening in the bottom of said stationary housing.

* * * * *